US005812037A

United States Patent [19]

Block

[11] Patent Number: 5,812,037

[45] Date of Patent: Sep. 22, 1998

[54] STRIPLINE FILTER WITH CAPACITIVE COUPLING STRUCTURES

[75] Inventor: Christian Block, Graz, Austria

[73] Assignee: Siemens Matsushita Components GmbH & Co KG, Munich, Germany

[21] Appl. No.: 573,728

[22] Filed: Dec. 18, 1995

[30] Foreign Application Priority Data

Dec. 22, 1994 [DE] Germany ..... 44 46 103.8

[51] Int. Cl.[6] ..... H01P 1/203; H01P 7/08

[52] U.S. Cl. ..... 333/204; 333/219

[58] Field of Search ..... 333/202, 204, 333/219, 219.1, 245, 246

[56] References Cited

U.S. PATENT DOCUMENTS

| | | | |
|---|---|---|---|
| 5,097,237 | 3/1992 | Komazaki et al. | 333/204 |
| 5,105,173 | 4/1992 | Itou | 333/204 |
| 5,105,175 | 4/1992 | Kaltenecker | 333/219 |

FOREIGN PATENT DOCUMENTS

| | | | |
|---|---|---|---|
| 0478962 | 4/1992 | European Pat. Off. . | |
| 4031536 | 9/1992 | Germany . | |
| 62-0030403 | 2/1987 | Japan | 333/204 |
| 5029817 | 2/1993 | Japan | 333/204 |

OTHER PUBLICATIONS

Japanese Patent Abstract No. 5–110316, Sagawa, dated Apr. 30, 1993.

*Primary Examiner*—Robert Pascal
*Assistant Examiner*—Barbara Summons
*Attorney, Agent, or Firm*—Herbert L. Lerner; Laurence A. Greenberg

[57] ABSTRACT

A stripline filter includes a ceramic substrate having first and second mutually opposite side surfaces and an end surface. At least one stripline resonator is disposed on the first side surface. Capacitive coupling structures are disposed at the end surface for coupling a high-frequency signal in and out. Ground metallizing covers the ceramic substrate except for the first side surface and the end surface. The coupling structures are formed by coupling metal surfaces being disposed on the second side surface and a galvanic separation being disposed on the second side surface and separating the coupling metal surfaces from the ground metallizing; metal surfaces being disposed on the first side surface and being galvanically separated from the stripline resonators; and through holes being formed in the ceramic substrate for galvanically connecting the coupling metal surfaces and the metal surfaces to one another through the through holes.

11 Claims, 1 Drawing Sheet

STRIPLINE FILTER WITH CAPACITIVE COUPLING STRUCTURES

BACKGROUND OF THE INVENTION

Field of the Invention

The invention relates to a stripline filter having a ceramic substrate, at least one stripline resonator disposed on a side surface of the ceramic substrate, capacitive coupling structures disposed on an end surface of the ceramic substrate for coupling a high-frequency signal in or out, and ground metallizing disposed on all sides of the ceramic substrate with the exception of the end surface having the coupling structures and the side surface having the stripline resonators.

In known stripline filters, the coupling of the stripline resonators is typically done capacitively, by galvanically separating a surface on a base of a ceramic substrate from a surrounding ground, so that the surface forms a capacitor to a conductor track being separated by the dielectric and being disposed at the top on the ceramic substrate. In accordance with the plate capacitor formula, the capacitor is dependent on the e of the dielectric, the thickness of the substrate and the area of the surface. If that coupling capacity is needed, for instance, for injecting a microwave power in a power resonator, slight fluctuations in the location of the surface vary the frequency of the resonator mistuned by the coupling.

In order to overcome such difficulties, complicated structuring processes, photolithography/etching techniques and high-precision grinding techniques were needed in producing the substrate.

SUMMARY OF THE INVENTION

It is accordingly an object of the invention to provide a stripline filter, which overcomes the hereinafore-mentioned disadvantages of the heretofore-known devices of this general type and which has a virtually calibration-free resonator that is produced at an economical cost and even when coupled to other resonators to produce corresponding filters has slight resonant frequency tolerances and is distinguished by close-tolerance coupling capacitors.

With the foregoing and other objects in view there is provided, in accordance with the invention, a stripline filter, comprising a ceramic substrate having first and second mutually opposite side surfaces and an end surface; at least one stripline resonator disposed on the first side surface; capacitive coupling structures disposed at the end surface for coupling a high-frequency signal in and out; and ground metallizing covering the ceramic substrate except for the first side surface and the end surface; the coupling structures being formed by coupling metal surfaces being disposed on the second side surface and a galvanic separation being disposed on the second side surface and separating the coupling metal surfaces from the ground metallizing; metal surfaces being disposed on the first side surface and being galvanically separated from the stripline resonators; and through holes being formed in the ceramic substrate for galvanically connecting the coupling metal surfaces and the metal surfaces to one another through the through holes.

In accordance with another feature of the invention, the coupling structures and the stripline resonators are mutually spaced apart by a spacing defining a coupling capacity between the coupling structures and the stripline resonators.

In accordance with a further feature of the invention, the metal surfaces are spaced apart by a spacing determining a size of an external coupling.

In accordance with an added feature of the invention, there are provided further stripline resonators being added for increasing selection properties of the filter.

In accordance with an additional feature of the invention, the metallizing structures are produced by thick-film technology (such as screenprinting with thick-film silver) or by thin-film technology (copper, etched).

In accordance with yet another feature of the invention, the metallizing structures are pressed into the ceramic substrate prior to a sintering operation.

In accordance with yet a further feature of the invention, there is provided an additional coupling capacitor for additionally capacitively coupling the coupling structures.

In accordance with yet an added feature of the invention, there is provided a line discontinuity in the form of a broadside jump being disposed in the stripline resonators.

In accordance with yet an additional feature of the invention, there is provided a ceramic cap disposed above the ceramic substrate.

In accordance with a concomitant feature of the invention, the ceramic substrate is thicker than the ceramic cap.

Other features which are considered as characteristic for the invention are set forth in the appended claims.

Although the invention is illustrated and described herein as embodied in a stripline filter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
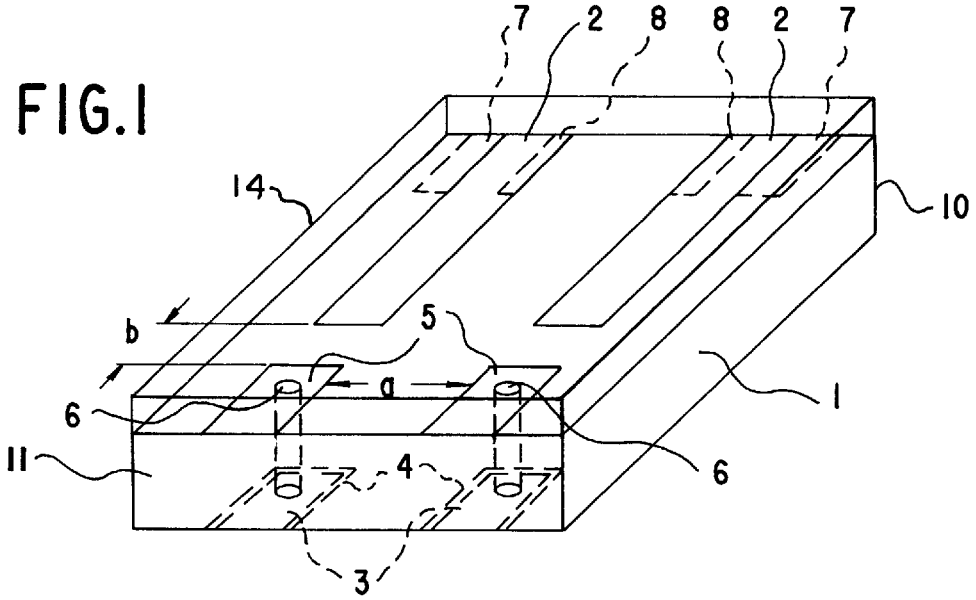
FIG. 1 is a diagrammatic, perspective view of a stripline filter.

Referring now to the figures of the drawing in detail and first, particularly, to FIG. 1 thereof, there is seen a ceramic substrate 1 having a first surface on which two stripline resonators 2 are disposed. Coupling metal surfaces 3 on a second surface of the ceramic substrate 1 are separated from a ground metallizing on all sides by a galvanic separation 4. Metal surfaces 5 are disposed on the surface of the ceramic substrate 1 on which the stripline resonators 2 are located. The surfaces 5 are contacted with the coupling metal surfaces 3 with the aid of through holes 6 that are preferably metallized on the inside. The coupling of the stripline filter is thus accomplished as a result of the fact that the coupling metal surfaces 3 that are galvanically separated from the surrounding ground by the separation surfaces 4, are through-contacted to the other side of the ceramic substrate 1, and the capacitive coupling with the stripline resonators 2 takes place on the opposite side. Even if the component becomes slightly larger as a result of this provision, the coupling is determined primarily by the spacing of the structures 2, 5 rather than by the substrate thickness, with the substrate preferably being formed of highly dielectric microwave ceramic. The adhesion strength of the coupling structure 3–6 can be markedly improved due to the through contacting with the aid of the through holes 6. The structures 3 & 4 on the ceramic substrate can be produced mechanically or by etching with markedly greater tolerances and thus possibly at less effort and expense. The coupling can likewise be brought about by etching techniques, and the location of the photomask for the coupling capacitor is not critical.

The line structures 2, 3, 5 & 6 can be produced either by thick-film technology (screenprinting with thick-film silver) or thin-film technology (etched copper).

Another possibility is to impress the structure into the ceramic body prior to sintering. When the metallizing is removed from the top, the resonant frequency is unaffected or hardly affected.

A spacing b between the stripline resonators 2 and the metal surfaces 5 of the coupling structure determines the magnitude of the coupling capacitance. The capacitive coupling effects the transformation of the low-impedance stripline resonator (typically 5 to 10 Ω) to the adaptation to 50 or 75 Ω, which is required in most applications. A spacing a between the metal surfaces 5 of the coupling structure determines the size of the external coupling. The location of two notches in the filter characteristic can be adjusted to suit a given application by adjusting the capacitance.

The thus-created filter is distinguished by low insertion damping, high depletion selection, and high or complete freedom from calibration. It is moreover markedly flatter than a microwave ceramic filter of comparable properties made from coupled coaxial resonators.

Figure 2:
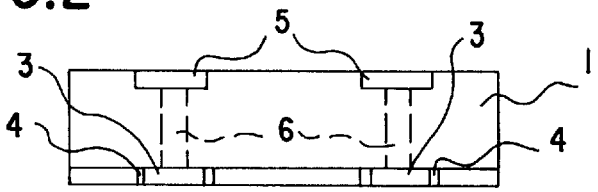
FIG. 2 is a side-elevational view of the stripline filter of FIG. 1.

In FIG. 2, the stripline filter of FIG. 1 is shown in a side view. FIGS. 1 and 2 show that the metal surfaces 5 are aligned opposite the coupling metal surfaces 3.

A further feature of the dipole filter described herein can be increasing the selection properties of the filter by adding additional stripline resonators.

The possibility also exists of producing flat single resonators with only one stripline resonator, which by way of example, when connected as a frequency-determining component of an oscillator (bandpass wiring) or as a band illumination filter, can act as notch filters for additionally filtering noise frequencies. The conductor tracks can be made quite narrow, and therefore higher characteristic impedances can be achieved. An oscillator can then be better drawn (higher quality).

It is also possible for the filter to be shielded through the use of a hoop or a housing disposed above the top, which by way of example is soldered or glued to the ceramic substrate 1. If especially stringent demands for frequency accuracy are made, the filter can be readjusted through housing slits or through the use of tuning tabs inserted into the slits.

In order to provide further miniaturization, the possibility also exists of not mounting a shielding plate but instead mounting a substrate that is metallized except for a surface oriented toward the filter on the basic substrate (joining can be performed by soldering or gluing).

Figure 3:
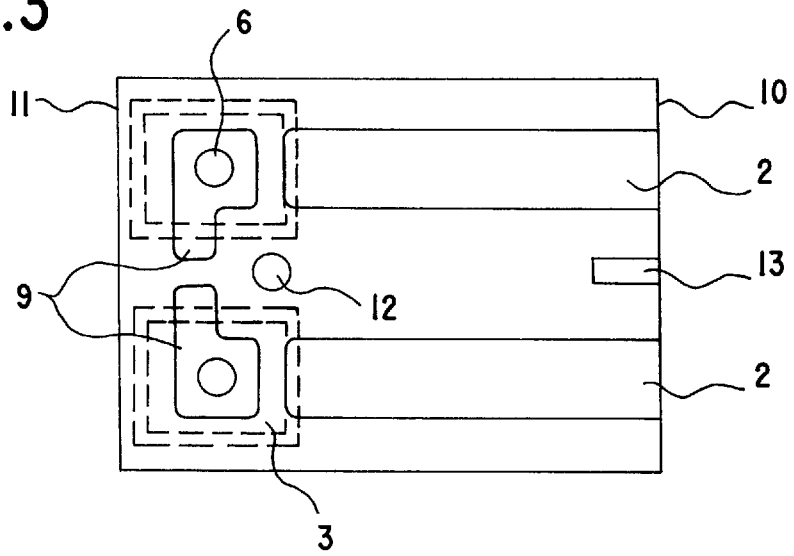
FIG. 3 is a plan view of a further embodiment of a stripline filter.

In various applications in the area of cordless telephones and cellular phones or mobile radio, an especially high unilateral steepening of the filter characteristic is desired, in order to purposefully suppress mirror frequencies, or in the case of duplexing operation the neighboring band. To that end, FIG. 3 shows an exemplary embodiment which has one additional coupling capacitor 9 that additionally capacitively couples the coupling structures. Through-contacting devices (holes 12 or slits 13) can additionally be used for adjusting the coupling between the individual resonators 2. In the exemplary embodiment of FIG. 3, an open side 11 (which is free of metallizing) is located in the region of the coupling structure, and a short-circuit side 10 is located opposite it.

Another option for unilateral improvement of the edge steepness is to produce a line discontinuity in the form of a broadside jump in the resonator line. As is illustrated in FIG. 1, this is done either by giving the stripline resonator 2 a reduced cross section (by using a metal-free surface 8) in the region of the short-circuit side 10, or widening it in this region (by using an additional metallizing 7). In the first instance, an inductive effect results, while in the second a capacitive effect results.

The option exists in this case of either attaining the coupling through the through-contacting shown in FIG. 1, or of performing a direct capacitive coupling (without through holes 6). In the case of a direct capacitive coupling, the stripline resonators 2 are all disposed continuously up to the metallizing-free open side 11.

Such filters having a broadside discontinuity in the stripline resonators 2 are distinguished by the fact that the filter characteristic becomes steeper toward lower frequencies. If the broadside discontinuities are reflected to the open side 11, then steepening toward higher frequencies can be achieved. Another distinction of broadside discontinuities with a capacitive effect (an increase in the dimensions by the amount of the thickness of the surface 7) is that the coupling is highly replicable, since the line discontinuity is extended to the outside.

The broadside discontinuity can optionally also be provided in such a way that one portion of the inner conductor is shifted relative to the other. The notch position can additionally be adjusted in this way. Since this involves an undercut, this body can be produced only in the form described above. In other words, it cannot be pressed in one piece (monolithically).

If a ceramic 14 cap is to be mounted in addition, then the possibility exists of joining the cap in the pressed state to the likewise unfired basic substrate and then of sintering them. The result is that the work step of demetallizing the functionally necessary metallizing-free surfaces, or of keeping them free of metallization, which is otherwise necessary, can be omitted.

In order to minimize the insertion damping and thus to reduce losses, the stripline filter can be constructed asymmetrically to the extent that the ceramic substrate 1 is thicker than the ceramic cap. In this way, the unloaded quality of the resonators can be increased by up to 50%.

I claim:

1. A stripline filter, comprising:

a ceramic substrate having first and second mutually opposite side surfaces and an end surface;

at least one stripline resonator disposed on said first side surface and located at one side of a common plane;

capacitive coupling structures disposed at said end surface for coupling a high-frequency signal in and out of the filter, said capacitive coupling structures extending out from said end surface and being disposed at another side of the common plane opposite to the one side thereof; and ground metallizing covering said ceramic substrate except for said first side surface and said end surface;

said coupling structures being formed by:

coupling metal surfaces being disposed on said second side surface and a galvanic separation being disposed on said second side surface and separating said coupling metal surfaces from said ground metallizing;

metal surfaces disposed on said first side surface in direct opposite alignment with said coupling metal surfaces, said metal surfaces being galvanically separated from said stripline resonators; and said ceramic substrate having through holes formed therein for galvanically connecting said coupling metal surfaces and said metal surfaces to one another through said through holes.

2. The stripline filter according to claim 1, wherein said coupling structures and a corresponding one of said at least one stripline resonator are mutually spaced apart by a spacing defining a coupling capacity between said coupling structures and said corresponding stripline resonators.

3. The stripline filter according to claim 1, wherein said metal surfaces are spaced apart from each other by a spacing determining a size of an external coupling.

4. The stripline filter according to claim 1, wherein said at least one stripline resonator includes further stripline resonators being added for increasing selection properties of the filter.

5. The stripline filter according to claim 1, wherein metallizing structures including said capacitive coupling structures and said at least one stripline resonator are produced by thick-film technology.

6. The stripline filter according to claim 1, wherein metallizing structures including said capacitive coupling structures and said at least one stripline resonator are produced by thin-film technology.

7. The stripline filter according to claim 1, wherein metallizing structures including said capacitive coupling structures and said at least one stripline resonator are pressed into said ceramic substrate prior to sintering.

8. The stripline filter according to claim 1, including an additional coupling capacitor for additionally capacitively coupling said coupling structures.

9. The stripline filter according to claim 1, including a line discontinuity in the form of an inward lateral displacement being disposed in said at least one stripline resonator.

10. The stripline filter according to claim 1, including a ceramic cap disposed above said ceramic substrate.

11. The stripline filter according to claim 10, wherein said ceramic substrate is thicker than said ceramic cap.

* * * * *